US011376868B2

(12) United States Patent
Rothenbuhler et al.

(10) Patent No.: US 11,376,868 B2
(45) Date of Patent: Jul. 5, 2022

(54) CAPACITANCE SENSOR

(71) Applicants: Hewlett-Packard Development Company, L.P., Spring, TX (US); Dan Rothenbuhler, Boise, ID (US); Hao-Hua Zhu, Shanghai (CN); Dean Richtsmeier, Boise, ID (US)

(72) Inventors: Dan Rothenbuhler, Boise, ID (US); Hao-Hua Zhu, Shanghai (CN); Dean Richtsmeier, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 104 days.

(21) Appl. No.: 17/048,328

(22) PCT Filed: Aug. 7, 2018

(86) PCT No.: PCT/CN2018/099143
§ 371 (c)(1),
(2) Date: Oct. 16, 2020

(87) PCT Pub. No.: WO2020/029065
PCT Pub. Date: Feb. 13, 2020

(65) Prior Publication Data

US 2021/0101390 A1 Apr. 8, 2021

(51) Int. Cl.
*B41J 11/00* (2006.01)
*B65H 1/04* (2006.01)

(52) U.S. Cl.
CPC ..... *B41J 11/003* (2013.01); *B41J 11/0095* (2013.01); *B65H 1/04* (2013.01); *B65H 2511/11* (2013.01); *B65H 2511/12* (2013.01); *B65H 2511/22* (2013.01); *B65H 2553/23* (2013.01); *B65H 2801/06* (2013.01)

(58) Field of Classification Search
CPC ..... B41J 11/003; B41J 11/0095; B65H 1/04; B65H 2511/11; B65H 2511/12; B65H 2511/22; B65H 2511/23; B65H 2511/06
USPC ..... 358/1.2
See application file for complete search history.

(56) References Cited

U.S. PATENT DOCUMENTS 5,940,106 A 4/1999 Walker
6,315,473 B1 11/2001 Slippy
(Continued)

FOREIGN PATENT DOCUMENTS

CN 1482575 A 3/2004
CN 101190758 B 12/2010
(Continued)

*Primary Examiner* — Allen H Nguyen
(74) *Attorney, Agent, or Firm* — HP Inc. Patent Department

(57) ABSTRACT

A device (100) includes a sensor (101) to determine a capacitance between a first metal piece (209, 309, 409, 509, 609, 709, 809, 909) coupled to a paper tray (213, 413, 513, 913) of a printing device (206, 306) and a second metal piece (207, 307, 407, 507, 607, 707, 807, 907) coupled to a paper width adjuster (212) of the printing device (206, 306). The device (100) also includes a controlled (102) coupled to the sensor (101) comprising a processor (103) in communication with a memory resource (104) including executable instructions to determine a size of paper in the paper tray (213, 413, 513, 913) based on the determined capacitance.

15 Claims, 6 Drawing Sheets

(56) References Cited

U.S. PATENT DOCUMENTS

| | | | | |
|---|---|---|---|---|
| 6,388,452 | B1 * | 5/2002 | Picciotto | G01B 7/085 324/452 |
| 7,114,790 | B2 | 10/2006 | Seki et al. | |
| 7,367,642 | B2 | 5/2008 | Ouchi et al. | |
| 7,548,328 | B2 | 6/2009 | Hult et al. | |
| 7,645,012 | B2 | 1/2010 | Ikeda | |
| 2015/0168328 | A1 * | 6/2015 | Fomin | B65H 7/02 702/65 |
| 2017/0232765 | A1 | 8/2017 | Moriyama et al. | |
| 2020/0130386 | A1 * | 4/2020 | Eiyama | B41J 15/02 |

FOREIGN PATENT DOCUMENTS

| | | | |
|---|---|---|---|
| CN | 103522767 | A | 1/2014 |
| CN | 102464214 | B | 4/2014 |
| CN | 104685351 | B | 8/2016 |
| JP | 2013049197 | A | 3/2013 |

* cited by examiner

CAPACITANCE SENSOR

BACKGROUND

Capacitance is the ability of a system to store an electric charge. Put another way, capacitance is the ratio of the change in an electric charge in a system to the corresponding change in its electric potential. Capacitance may also include capacitance that occurs between two charge-holding objects in which the current passing through one passes over into the other.

DETAILED DESCRIPTION

Printing devices such as printers and scanners, among others, can have paper width guides to position paper entering the printing device. In some instances, it may be desirable to know the width, length, and/or overall shape of the paper that will be printed or scanned before it enters the printing device. For example, this enables margins to be set to prevent printing off the edge of the paper, as well as allowing clipping of a scanned image to reduce non-image defects at an edge of the paper. Additionally, for example, a user may want to print something of a particular size (e.g., envelope), so the user may want to know if that particular size of paper is currently in a paper tray of the printing device.

Some approaches to determining a paper size can include using multiple discreet sensors that correspond to common paper sizes (e.g., letter and A4). For instance, determinations about a limited number of paper sizes may be made in such an example. Such an approach uses multiple sensors, which can increase cost, and may not allow for detection of non-standard or less common paper sizes (e.g., card or letter envelope). Other approaches prompt users to enter a paper size ahead of printing. Such approaches can result in incorrect paper sizes to be set due to human error. In addition, for simple printing devices without a user interface (e.g., a graphical user interface), it may be challenging to prompt a user to enter and/or select a paper size.

Still other approaches can include the use of linear displacement sensors and/or rotary sensors for detecting paper width, but these sensors and/or rotary sensors can be expensive, especially as resolution increases. Additionally, such approaches use additional cabling to connect the sensors and/or rotary sensors to electronics of the printing device.

In contrast, examples of the present disclosure can include a capacitance sensor for determining a paper size that can detect a plurality of paper sizes, including common and uncommon paper sizes, without user input and at a reduced cost as compared to other approaches. In addition, examples of the present disclosure can include fewer and less complicated components as compared to other approaches. For instance, capacitance can be detected between conductive materials (e.g., metal pieces) coupled to the printing device at particular locations. This capacitance can be used to determine a paper size in a paper tray of the printing device.

Figure 1:
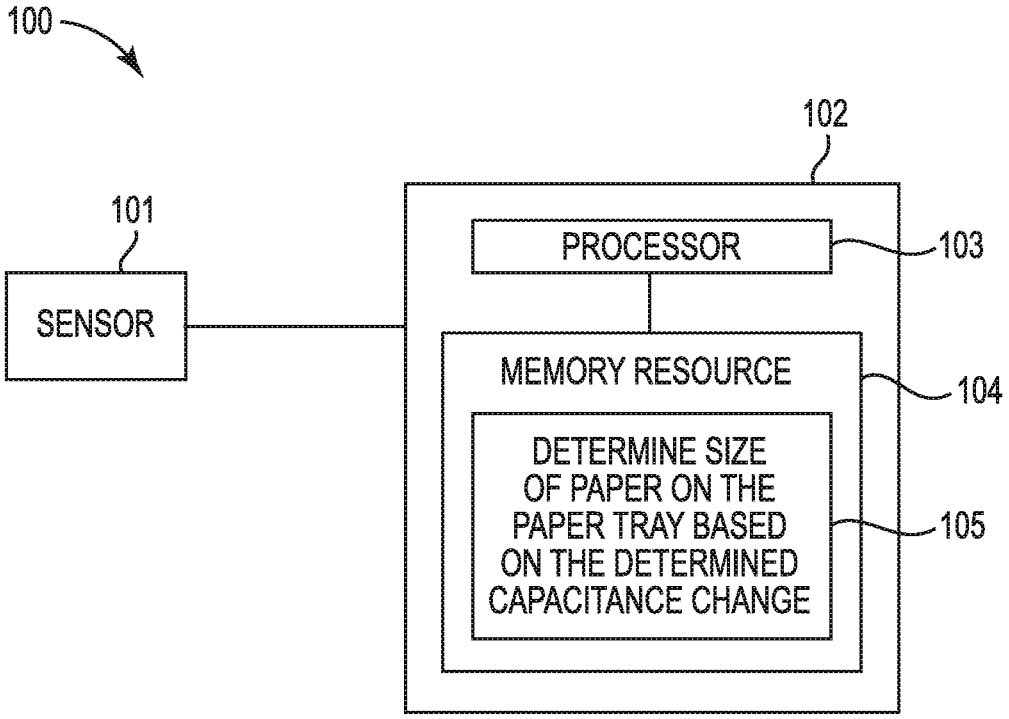
FIG. 1 illustrates a diagram of an example of a device including a sensor and a controller according to the present disclosure.

FIG. 1 illustrates a diagram of an example of a device 100 including a sensor 101 and a controller 102 according to the present disclosure. Controller 102 can be coupled to sensor 101 and can include a processor 103 in communication with a memory resource 104 (e.g., a non-transitory machine-readable medium) including instructions 105 executable by processor 103 to perform the operations as described herein (e.g., by executing the instructions store on memory resource 104). As used herein, coupled can include coupled via various wired and/or wireless connections between devices such that data can be transferred in various directions between the devices. The coupling need not be a direct connection, and in some examples, can be an indirect connection.

The operations are not limited to a particular example described herein and may include additional operations such as those described with respect to FIGS. 2-9. Memory resource 104 can be any type of volatile or non-volatile memory or storage, such as random-access memory (RAM), flash memory, read-only memory (ROM), storage volumes, a hard disk, or a combination thereof.

Sensor 101 may determine a capacitance between a first metal piece coupled to a paper tray of a printing device and a second metal piece coupled to a paper width adjuster of the printing device. As used herein, "paper width adjuster" can include an adjuster of paper width, paper length (e.g., a length guide), and/or a combination of the two, among others. For instance, the first metal piece may be a conductive material such as a flexible flat cable (FFC), and the second metal material can be a conductive material strip, such that as the paper width adjuster is moved to fit a paper size, the second metal piece changes from where it is barely covering a small strip of the FFC to where it is covering a larger portion of the FFC coupled to the paper tray. Based on the capacitance, memory resource 104 can store instructions 105 executable by the processor 103 to determine a size of the paper in the paper tray.

For instance, in some examples memory resource 104 can store instructions 105 executable by the processor 103 to determine a size of paper in a paper tray based on the determined capacitance. In some instances, determining the capacitance between the first and the second metal pieces by measuring the capacitance at the two positions of the first and the second metal pieces and correlating them to fixed distances can allow for interim positions to be calculated. For example, to reduce error in detecting a paper size, the paper width adjuster can be moved to a widest and a narrowest position. Measuring the capacitance at these two positions and correlating them to fixed distances can allow for interim positions to be calculated using linear interpolation since capacitance will change linearly between these two points. For instance, a sensor can be calibrated when a piece of paper is fed by measuring an output of the sensor, and as paper is fed, verifying that the sensor output matches the paper size that is fed.

A determination of a paper size can be used to determine if a print process can proceed, in some examples. For instance, if a user attempts to send a print job that does not align with a paper size currently in the printing device, an alert may be sent to the user that the paper size is incorrect. Additionally or alternatively, a user may be able to see what paper size is in the printing device before sending a print job, such that they know whether they need to adjust the paper size based on their desired print job.

Put another way, based on the size of paper in the paper tray as determined by controller 102, a job such as a print job or scan job can be allowed in response to a determination that the job requested of the printing device can be performed. A source of the request (e.g., a user, administrator, source computing device, graphical user interface, etc.) can be alerted in response to a determination that a job requested of the printing device cannot be performed.

Figure 2:
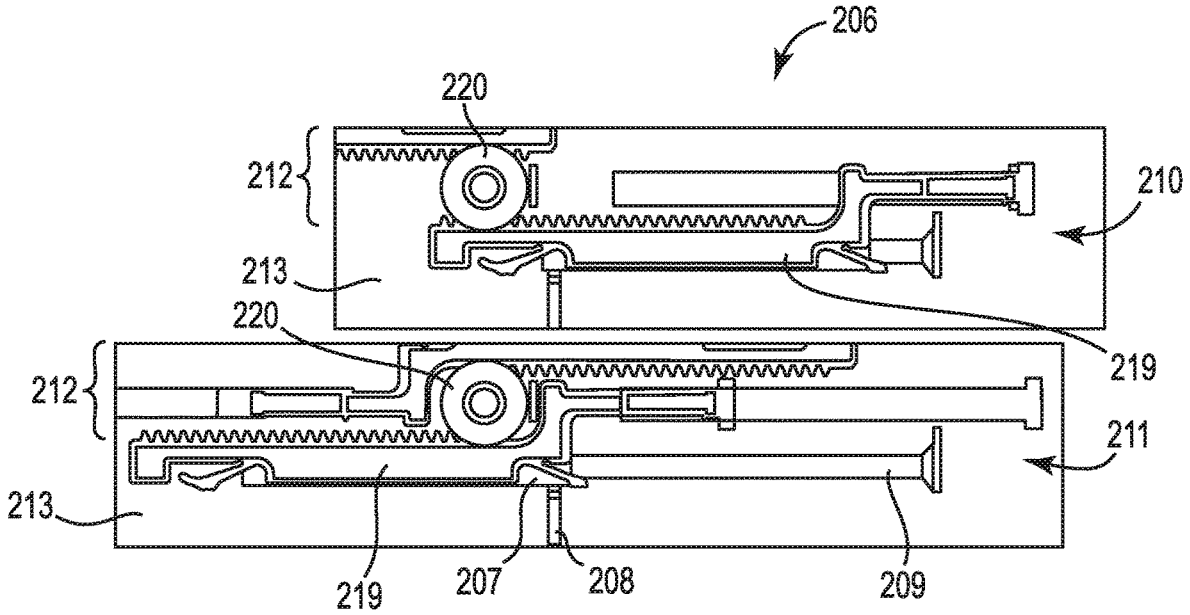
FIG. 2 illustrates a diagram of an example of a printing device including a first metal piece and a second metal piece according to the present disclosure.

FIG. 2 illustrates a diagram of an example of a printing device 206 including a first metal piece 209 and a second metal piece 207 according to the present disclosure. FIG. 2 illustrates a paper width adjuster 212 in different positions 210 and 211. Paper width adjustor can be used to adapt a paper tray 213 to a particular size of paper. While the paper width adjuster 212 illustrated in FIG. 2 includes a gear 220 and rack 219 mechanism for adjustment, other paper width adjustor mechanisms may be used.

In the example illustrated in FIG. 2, a paper tray 213 (seen from below in FIG. 2), has a paper width adjuster 212 coupled thereto for adjustment and/or centering of paper on the paper tray 213. In position 210, paper width adjuster 212 is in a letter paper position. In position 211, paper width adjuster 212 is in a narrower paper position (e.g., a narrowest paper position). In some examples, positions such as positions 210 and 211 can be used to determine the width of paper in paper tray 213 using capacitive sensing.

For instance, printing device 206 can include a first metal piece 209 coupled to paper tray 213 and a second metal piece 207 coupled to paper width adjuster 212. First metal piece 209 can be connected (e.g., via a sensing trace) to an electronics portion of printing device 206, for instance an electronics board (e.g., printed circuit board (PCB), application specific integrated circuit (ASIC), digital ASIC, etc.). By connecting directly to an electronics board, costs can be reduced because additional cables and/or other connection components can be avoided. The first metal piece 209 can include components for connection to the electronics board without addition connections. Such an example can include the first metal piece being an FFC including flat cables covered by an insulator. An FFC can include components for directly connecting to an electronics board.

Second metal piece 207 may be a metal strip in some instances and may be grounded by grounding tab 208. Grounding tab 208 can allow for movement of second metal piece 207 (e.g., over grounding tab 208). Other grounding mechanisms may be used to ground second metal piece 207 in some examples. While the first metal piece 209 and the second metal piece 207 are referred to herein as metal pieces, other conductors or semiconductors may be used.

As paper width adjuster 212 is adjusted, second metal piece 207 moves with paper width adjuster 212, and different amounts of first metal piece 209 and second metal piece 207 overlap (but may not touch) one another. An insulator separates first metal piece 209 and second metal piece 207; for instance, an insulator surrounding a portion of first metal piece 209 (e.g., plastic surrounding cables within an FFC) acts as a separating insulator. As the first metal piece 209 and the second metal piece 207 overlap one another, a capacitance can be determined. For instance, in position 211, a smaller amount of overlap between the first metal piece 209 and the second metal piece 207 occurs as compared to position 210. The different amounts of overlap result in different capacitances. A sensor, for instance as illustrated in FIG. 1, can determine the capacitance between the first metal piece 209 and the second metal piece 207 and determine a paper width based on the determination.

In the example illustrated in FIG. 2, position 210 can be considered a widest position of paper width adjuster 212 (e.g., letter size paper) and position 211 can be considered a narrowest position of paper width adjuster 212. In some examples, to reduce error in detecting a paper size, paper width adjuster can be moved to widest position 210 and narrowest position 211 and capacitance at the two positions can be determined. The determined capacitances at positions 210 and 211 can be correlated to fixed distances allowing interim positions to be determined.

In some examples, a capacitance sensor can be calibrated when paper is fed into a paper tray by measuring an output of the sensor, and as paper is fed verifying that the sensor output matches the paper size that is fed. In some examples, this can be done by detecting the paper length using a leading edge and/or a trailing edge sensor that may be found in print devices. In examples in which paper sizes are known, knowing the paper length can enable verification of the paper width.

Figure 3:
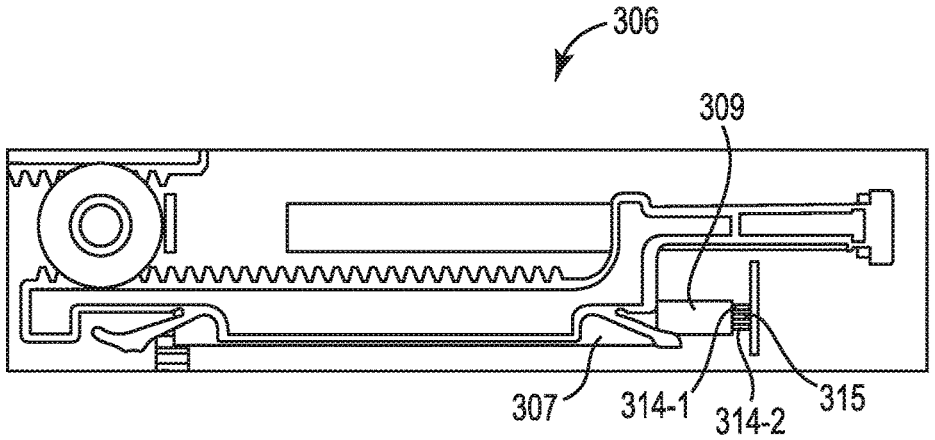
FIG. 3 illustrates a diagram of another example of a printing device including a first metal piece and a second metal piece according to the present disclosure.

FIG. 3 illustrates a diagram of another example of a printing device 306 including a first metal piece 309 and a second metal piece 307 according to the present disclosure. Because a printing device may contain conductive materials other than first metal piece 309 and second metal piece 307, guard traces 314 may be used to prevent other conductive materials from affecting a capacitance determination.

For instance, first metal piece 309 can include a sensing trace 315 surrounded by guard traces 314-1 and 314-2 (referred together herein as guard traces 314). Guard traces 314 can shield the first metal piece 309 (and sensing trace 315) from conductors other than the second metal piece 307, for example. Guard traces 314 can be driven to be an approximately same voltage as sensing trace 315 to block field current from leaking. For instance, to sense the capacitance, a voltage and current can be driven into a triangle waveform. By driving a constant current, frequency can be measured, and capacitance can be determined. By driving guard traces 314 with a same waveform, guard traces 314 can block field current from leaking into other grounded conductive materials in printing device 306. Put another way, if guard traces 314 have approximately a same voltage as sensing trace 315, field current can be terminated in guard traces 314. In some examples, driving guard traces 314 at a same rate as sensing trace 315 can result in no voltage change between sensing trace 315 and guard traces 314, which in turn can result in no current effects. For instance, sensing trace 315 can be shielded from the effects of other conductors.

While the example illustrated in FIG. 3 illustrates one sensing trace 315 surrounded by two guard traces 314, more sensing and/or guard traces can be used. For instance, two sensing traces may double an amount of capacitance in first metal piece 309, which may increase sensing capability, sensitivity, and/or accuracy. In such an example, a pattern of guard trace, sensing trace, guard trace, sensing trace, guard trace may occur. Guard and sensing traces may be increased in number until a desirable sensing signal is reached. The pattern of guard trace, sensing trace (with guard traces on the ends) can be repeated. In some instances of the present disclosure, no guard traces are present.

Figure 4:
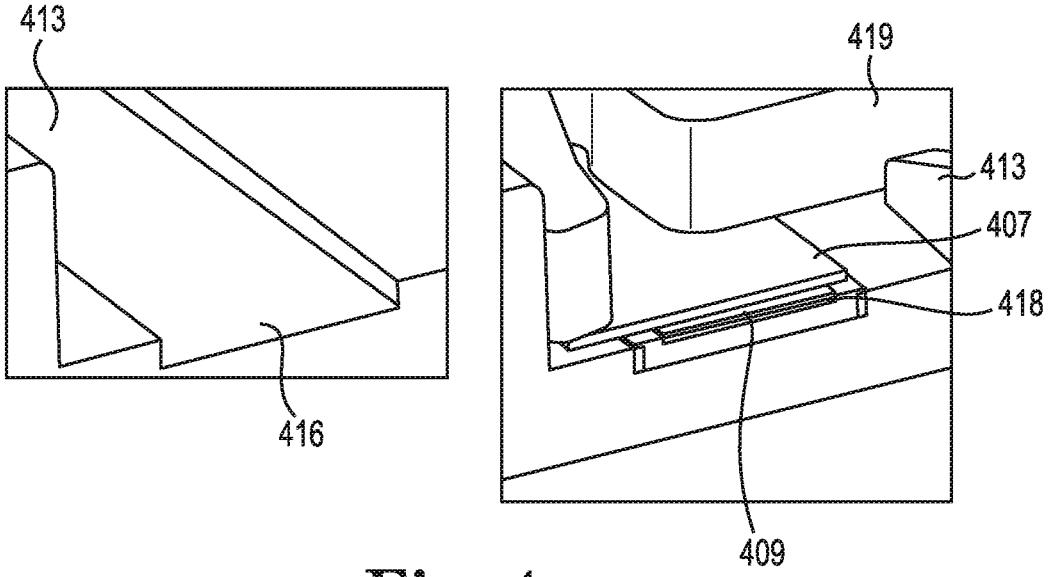
FIG. 4 illustrates a diagram of an example paper tray including a spring component according to the present disclosure.

FIG. 4 illustrates a diagram of an example paper tray 413 including a spring component according to the present disclosure. The image on the left illustrates paper tray 413 having a cut-out 416 to house a spring component. The image on the right illustrates paper tray 413 including rack 419, first metal piece 409, second metal piece 407, and foam material 418. Components such as first metal piece 409 and second metal piece 407 may have impurities (e.g., not uniform, have irregularities, etc.) and because capacitance is dependent on a distance between two conductors, the spring component may be used to maintain a spacing variation below a particular threshold between first metal piece 409 and second metal piece 407.

For instance, the particular threshold can include a space between first metal piece 409 and second metal piece 407 below a distance of two millimeters or less. Two millimeters, as used herein, is an example and other threshold amounts may be used. In some instances, a particular threshold may include a particular number of gaps between first metal piece 409 and second metal piece 407. For instance, the spring component can reduce gaps between first metal piece 409 and second metal piece 407 to achieve a more uniform distance between the two. In some instances, the distance between the first metal piece 409 and the second metal piece 407 is zero, such that they are firmly pressed against one another.

For instance, cut-out 416 may house foam material 418 which acts as the spring component to press the first metal piece 409 against the second metal piece 409 to reduce variation in capacitance due to a spacing variation between the first metal piece 409 and the second metal piece 407. Foam material 418 can include, for instance, a foam material having sufficient force to deflect and keep uniform pressure on first metal piece 409, reducing gaps between first metal piece 409 and second metal piece 407. Foam material 418, in some examples can be fitted into cut-out 416 using an interference fit. In some instances, a spring component other than a foam material may be used, such that it provides sufficient force to deflect and keep uniform pressure on first metal piece 409, reducing gaps between first metal piece 409 and second metal piece 407. In examples of the present disclosure in which a foam material acts as a spring component, an insulator can be present between the first metal piece 409 and the second metal piece 407.

Figure 5:
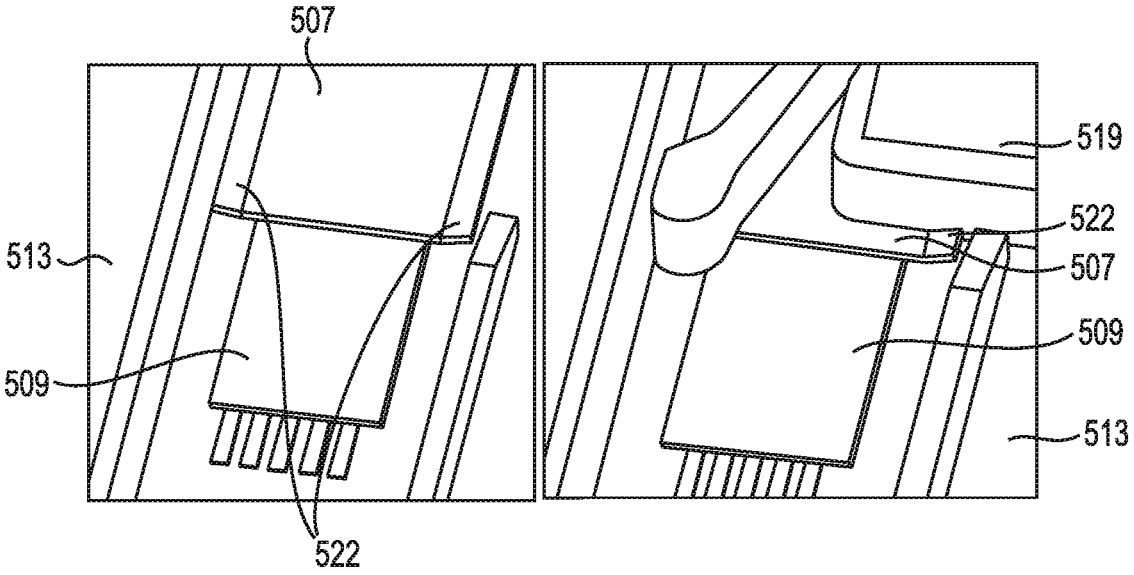
FIG. 5 illustrates a diagram of another example paper tray including a spring component according to the present disclosure.

FIG. 5 illustrates a diagram of another example paper tray 513 including a spring component according to the present disclosure. The image on the left illustrates paper tray 513 without a rack, while the image on the right illustrates paper tray 513 with rack 519. In some examples, second metal piece 507 can include folds 522 to act as the spring component to provide a spring force against rack 519 to keep second metal piece 507 tightly against first metal piece 509. The length of second metal piece 507 can have the folds 522, reducing gaps between first metal piece 509 and second metal piece 507. In examples of the present disclosure in which folds 522 act as a spring component, an insulator can be present between the first metal piece 509 and the second metal piece 507.

Figure 6:
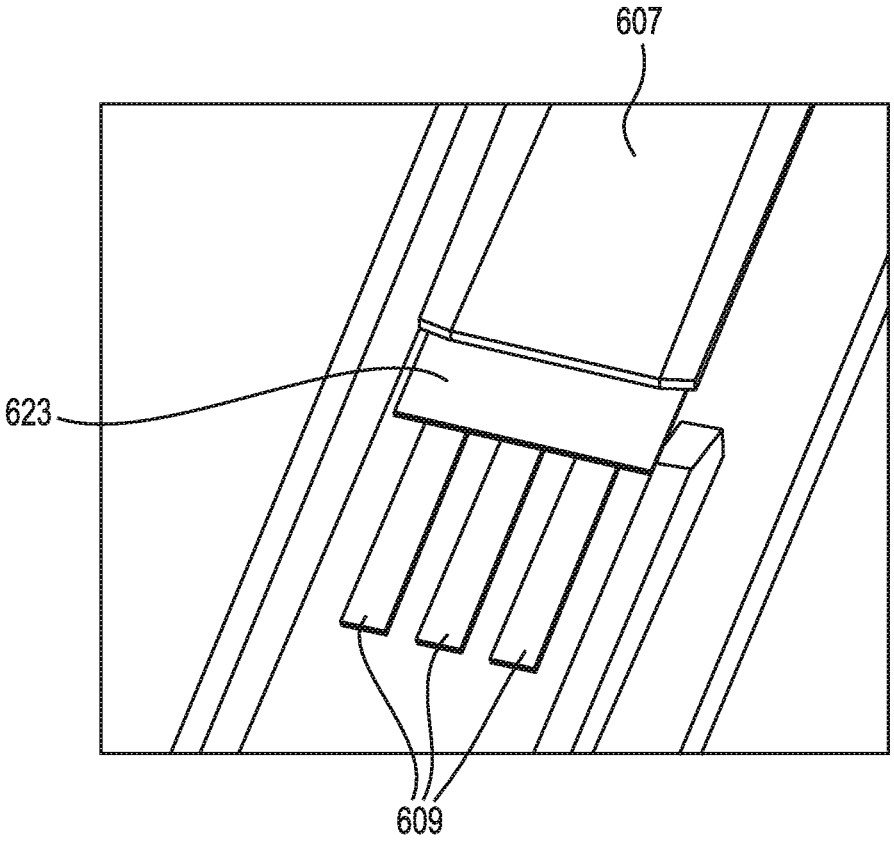
FIG. 6 illustrates a diagram of an example first metal piece and an example second metal piece separated by an insulator according to the present disclosure.

FIG. 6 illustrates a diagram of an example first metal piece 609 and an example second metal piece 607 separated by an insulator 623 according to the present disclosure. In some instances, first metal piece 607 can include metal sensing traces separated from second metal piece 607 by an insulator such as an insulating sheet. For example, if an increased capacitance is desired, a first metal piece 607 that is not an FFC may be used to avoid a set size of the FFC (e.g., cannot change FFC width). In such an example, metal (or other conductive material) sensing traces can be used in place of the FFC, with an insulator 623 being used in place of an insulating material that surrounds an FFC.

In some examples, first metal piece 609 can include an insulator having a metal layer deposited thereon. For instance, first metal piece 609 can be a metalized plastic material. Insulator 623 may still be present between the metal layer and the second metal piece 607. Such an approach may allow for increase in capacitance, similar to the use of metal sensing traces as the first metal piece 609, in some examples.

Figure 7:
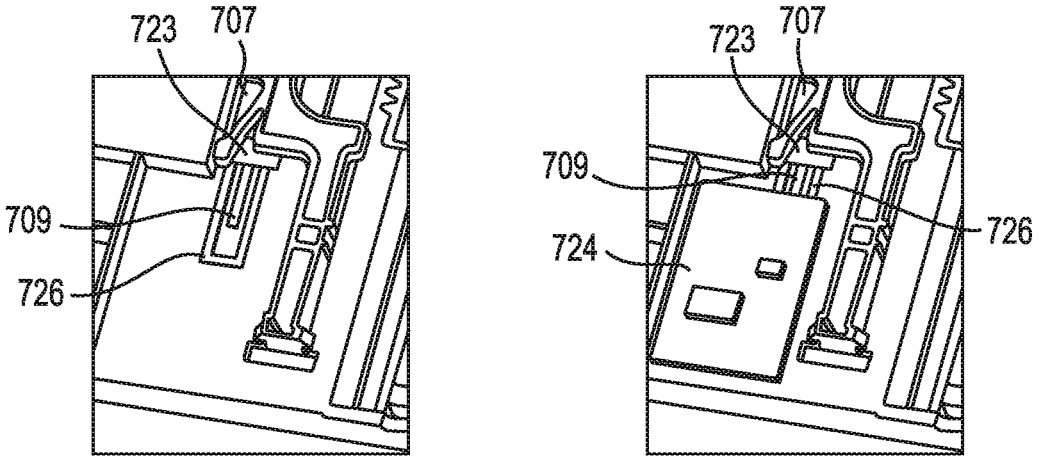
FIG. 7 illustrates a diagram of another example first metal piece and second metal piece separated by an insulator according to the present disclosure.

FIG. 7 illustrates a diagram of another example first metal piece 709 and second metal piece 707 separated by an insulator 723 according to the present disclosure. The image on the left illustrates first metal piece 709 (e.g., FFC, metal traces, metalized plastic, etc.) separated by insulator 723 from second metal piece 707. The image on the right illustrates first metal piece 709 directly connected to electronics board 724. A sensing trace of first metal piece 709 can be directly connected to electronics board 724, for instance via a spring, carbon foam, etc. As first metal piece 709 and second metal piece 707 are further from a sensor, stray capacitance may be detected by the sensor. The sensor may sense capacitance from other conductors in the printing device, for instance. By directly connecting a sensing trace of first metal piece 709 to electronics board 724, stray capacitance detection can be reduced. In such an example, guard traces may be used (e.g., the outside traces 726 are guard traces) or may not be used (the outside traces 726 are additional sensing traces or they are not present).

In some examples of the present disclosure, keeping the first metal piece 709 and the second metal piece 707 near the electronics board 724 can reduce stray and/or incorrect capacitance that resulted from unstable and/or moving cables within a printing device. In some instances, guard traces can reduce this stray and/or incorrect capacitance.

Electronics board 724, in some instances, can be located a threshold distance away from the paper width adjuster to reduce variation in capacitance due to long traces between an area comprising the capacitive sensor and a remote printer controller electronics board. As used herein, a threshold distance away from the paper width adjuster can include a distance close enough such that a desired lower limit of capacitance variation is reached. In some instances, the first metal piece 707 and the second metal piece 709 and/or the paper width adjuster being a threshold distance away and/or directly connected to electronics board 724 can reduce costs, as connector costs can be reduced or eliminated.

Figure 8:
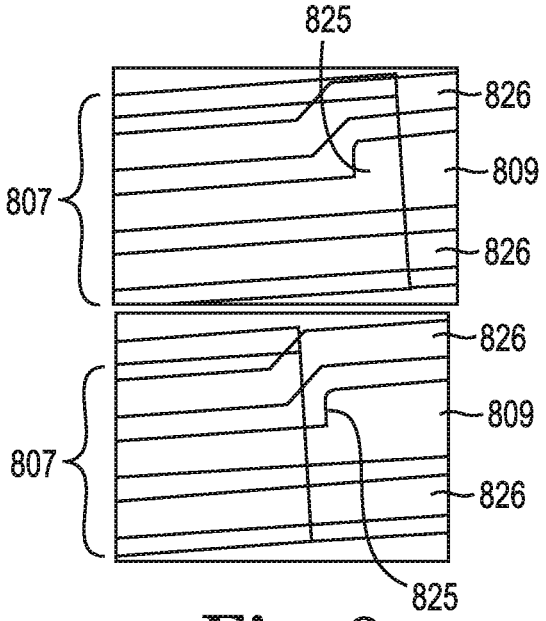
FIG. 8 illustrates a diagram of an example first metal piece and an example second metal piece according to the present disclosure.

FIG. 8 illustrates a diagram of an example first metal piece 809 and an example second metal piece 807 according to the present disclosure. The top image illustrates a first position of a paper width adjuster (e.g., letter paper position for second metal piece 807), and the bottom image illustrates a second position of the paper width adjuster (e.g., A4 paper position for second metal piece 807. Because a width difference between letter paper size and A4 paper size is not large (e.g., about 6 millimeters), a determined capacitance change may be very small and potentially undetectable. In the example illustrated in FIG. 8, a size of a sensing trace can be increased at 825, which corresponds to a threshold at which the paper width adjuster moves between A4 and letter size paper. By increasing the sensing trace size, there can be an increased transition between the two paper size positions, so even with a very small size difference, a capacitance change can be large enough to be detected. As the first metal piece 809 and the second metal piece 807 overlap one another, a slope of the sensing trace and a size of the sensing trace can change depending on location, which can improve accuracy of a paper size determination based on a capacitance determination.

Put another way, first metal piece 809 can include a plurality of sensing traces having modifiable shapes to amplify the capacitance between the first metal piece 809 and the second metal piece 807 as a function of linear motion of paper guides of the paper adjuster in sizes corresponding to paper size such as paper width, paper length, and/or paper shape differences, among others. While examples described with respect to FIG. 8 include A4 and letter paper sizes, other paper sizes may be acknowledged with sensing trace size and/or slope changes. Sensing trace 809, in some instances, can be surrounded by traces 826, which can be additional sensing traces or guard traces.

Figure 9:
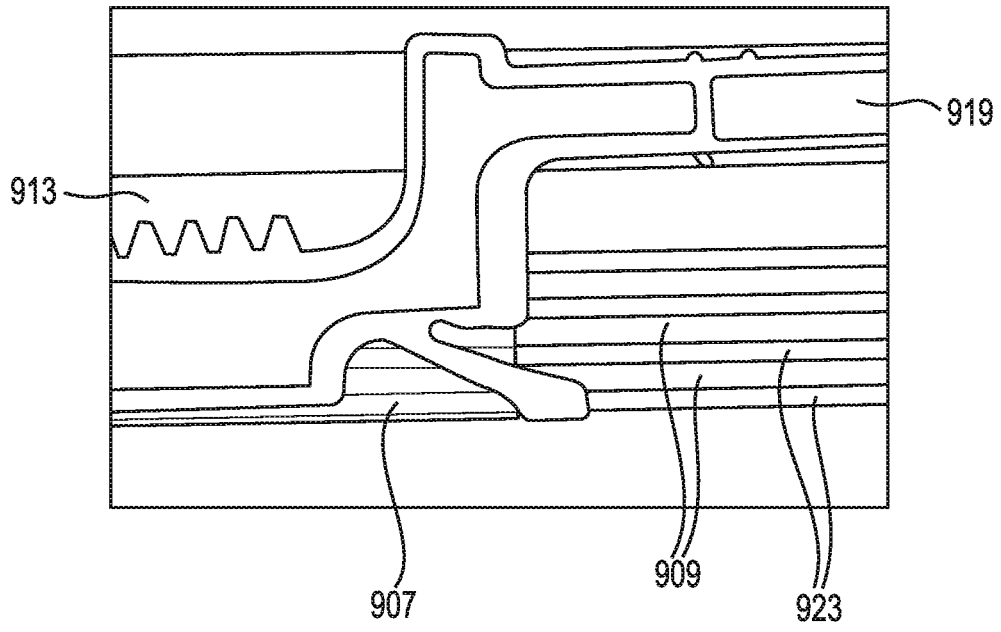
FIG. 9 illustrates a diagram of another example printing device including a paper tray, rack, first metal piece, and second metal piece according to the present disclosure.

FIG. 9 illustrates a diagram of another example printing device including a paper tray 913, rack 919, first metal piece 909, and second metal piece 907 according to the present disclosure. In some examples, paper tray 913 may be a conductive material. In such an example, an insulator, such as insulating sheet 923 can be used to insulate first metal piece 909 and second metal piece 907 from paper tray 913.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense. Further, as used herein, "a" element and/or feature can refer to one or more of such elements and/or features.

What is claimed:

1. A device, comprising:

a sensor to determine a capacitance between a first metal piece coupled to a paper tray of a printing device and a second metal piece coupled to a paper width adjuster of the printing device; and a controller coupled to the sensor and comprising a processor in communication with a memory resource including instructions executable to determine a size of paper in the paper tray based on the determined capacitance.

2. The device of claim 1, wherein the metal piece is a flexible flat cable.

3. The device of claim 1, further comprising an electronics board located a threshold distance from the paper width adjuster.

4. The device of claim 1, further comprising an electronics board directly connected to a sensing trace of the first metal piece.

5. The device of claim 1, further comprising guard traces surrounding a sensing trace of the first metal piece to shield the first metal piece from conductors other than the second metal piece.

6. The device of claim 1, wherein the first metal piece comprises a plurality of sensing traces having modifiable shapes to amplify a capacitance change as a function of linear motion of paper guides of the paper adjuster in sizes corresponding to paper size differences.

7. A device, comprising:

a sensor to determine a capacitance between a first metal piece coupled to a paper tray of a printing device and a grounded second metal piece coupled to a paper width adjuster of the printing device; and a controller coupled to the sensor and comprising a processor in communication with a memory resource including instructions executable to:

determine a size of paper in the paper tray based on the determined capacitance; and based on the size determination:

allow a job in response to a determination that the job requested of the printing device can be performed; and alert a source of the request in response to a determination that a job requested of the printing device cannot be performed.

8. The device of claim 7, further comprising an insulator located between the first metal piece and the second metal piece.

9. The device of claim 7, further comprising a spring component to force the first metal piece against the second metal piece to maintain a spacing variation between the first metal piece and the second metal piece below a threshold.

10. A device, comprising:

a first metal piece coupled to a paper tray of a printing device;

a spring component between the paper tray and the first metal piece;

a second metal piece coupled to a paper width adjuster of the printing device and located on top of the first metal piece;

a sensor to detect a capacitance between the first metal piece and the second metal piece; and a controller coupled to the sensor and comprising a processor in communication with a memory resource including instructions executable to determine a size of paper in the paper tray based on the detected capacitance.

11. The device of claim 10, wherein the size of paper comprises the width of the paper.

12. The device of claim 10, wherein the size of paper comprises the length of the paper.

13. The device of claim 10, wherein the spring component comprises a foam layer.

14. The device of claim 10, wherein the spring component comprises a fold in the second metal piece.

15. The device of claim 10, wherein the first metal piece comprises an insulator having a metal layer deposited thereon.

* * * * *